US011788722B2

(12) United States Patent
Rapp et al.

(10) Patent No.: US 11,788,722 B2
(45) Date of Patent: Oct. 17, 2023

(54) FLAME STABILIZER FOR NATURAL DRAFT LEAN PREMIXED BURNER APPARATUS

(71) Applicant: The Regents of the University of California, Oakland, CA (US)

(72) Inventors: Vi Rapp, Berkeley, CA (US); Peter Therkelsen, Portland, OR (US)

(73) Assignee: The Regents of the University of California, Oakland, CA (US)

( * ) Notice: Subject to any disclaimer, the term of this patent is extended or adjusted under 35 U.S.C. 154(b) by 283 days.

(21) Appl. No.: 17/172,298

(22) Filed: Feb. 10, 2021

(65) Prior Publication Data

US 2021/0317984 A1 Oct. 14, 2021

Related U.S. Application Data

(60) Provisional application No. 62/980,546, filed on Feb. 24, 2020.

(51) Int. Cl.
*F23D 14/02* (2006.01)
*F23D 14/26* (2006.01)
*F23D 14/62* (2006.01)

(52) U.S. Cl.
CPC ..... *F23D 14/26* (2013.01); *F23D 14/02* (2013.01); *F23D 14/62* (2013.01); *F23D 2203/102* (2013.01)

(58) Field of Classification Search
CPC ..... F23D 14/26; F23D 14/02; F23D 14/62; F23D 2203/102
USPC ..... 431/326
See application file for complete search history.

(56) References Cited

U.S. PATENT DOCUMENTS

| | | | |
|---|---|---|---|
| 2,095,065 | A | 10/1937 | Hays |
| 3,084,736 | A | 4/1963 | Mental et al. |
| 3,363,662 | A | 1/1968 | Curtis |
| 3,647,146 | A | 5/1972 | Genbauffe |
| 3,768,131 | A | 10/1973 | Genbauffe |
| 3,780,954 | A | 12/1973 | Genbauffe |
| 5,139,417 | A | 8/1992 | Ghassemzadeh |
| 5,240,411 | A | 8/1993 | Abalos |

(Continued)

FOREIGN PATENT DOCUMENTS

| | | | |
|---|---|---|---|
| GB | 1162496 | A | 8/1969 |
| KR | 920001755 | B1 | 2/1992 |
| WO | WO-9318342 | A1 | 9/1993 |

OTHER PUBLICATIONS

International Search Report and Written Opinion for International Application No. PCT/US2016/056301 dated Dec. 16, 2016.

*Primary Examiner* — Avinash A Savani

(57) ABSTRACT

This disclosure provides systems, methods, and apparatus related to burner apparatus for lean premixed flames. In one aspect, an apparatus includes a burner plate, a burner body, and a mesh. A first surface of the burner plate defines a combustion surface for a fuel/air mixture. The burner plate defines a plurality of primary ports. The burner body defines a fuel-air mixing chamber. One surface of the burner body comprises the burner plate. The burner body defines an inlet for receiving air and a fuel in the fuel-air mixing chamber. The mesh is disposed in the fuel-air mixing chamber and is in contact with a second surface of the burner plate.

20 Claims, 5 Drawing Sheets

(56) References Cited

U.S. PATENT DOCUMENTS

| | | | | |
|---|---|---|---|---|
| 5,292,246 | A * | 3/1994 | Gateau | C01B 3/363 431/328 |
| 5,310,337 | A | 5/1994 | LiFshits et al. | |
| 5,437,262 | A | 8/1995 | George, II et al. | |
| 5,516,280 | A | 5/1996 | Kostiuk et al. | |
| 5,735,681 | A | 4/1998 | Cheng | |
| 5,803,725 | A | 9/1998 | Horn et al. | |
| 5,957,682 | A | 9/1999 | Kamal et al. | |
| 6,439,881 | B2 | 8/2002 | Haynes | |
| 6,499,990 | B1 | 12/2002 | Zink | |
| 6,672,302 | B1 | 1/2004 | Voorhis et al. | |
| 6,758,207 | B1 | 7/2004 | Hotard et al. | |
| 6,923,643 | B2 | 8/2005 | Schultz et al. | |
| 7,052,273 | B2 | 5/2006 | Sehmbi | |
| 7,665,426 | B2 | 2/2010 | O'Donnell | |
| 7,857,617 | B2 | 12/2010 | O'Donnell | |
| 8,616,193 | B2 | 12/2013 | Padgett | |
| 9,561,564 | B2 | 2/2017 | Kowald et al. | |
| 2003/0054313 | A1* | 3/2003 | Rattner | F23D 14/16 431/326 |
| 2004/0101797 | A1 | 5/2004 | Mosiewicz et al. | |
| 2005/0142509 | A1 | 6/2005 | Kim et al. | |
| 2006/0141412 | A1* | 6/2006 | Masten | F23D 14/145 431/326 |
| 2008/0131828 | A1 | 6/2008 | Ojiro et al. | |
| 2009/0188484 | A1 | 7/2009 | Nevarez et al. | |
| 2013/0104783 | A1 | 5/2013 | Wallenquest, Jr. | |
| 2014/0230701 | A1 | 8/2014 | Cheng et al. | |
| 2015/0147703 | A1 | 5/2015 | Noman et al. | |
| 2016/0102866 | A1 | 4/2016 | Cadima | |
| 2017/0122555 | A1* | 5/2017 | Owens | F23D 14/18 |
| 2018/0224120 | A1 | 8/2018 | Cheng et al. | |

* cited by examiner

FLAME STABILIZER FOR NATURAL DRAFT LEAN PREMIXED BURNER APPARATUS

RELATED APPLICATIONS

This application claims priority to U.S. Provisional Patent Application No. 62/980,546, filed Feb. 24, 2020, which is herein incorporated by reference. This application is related to U.S. patent application Ser. No. 15/942,915, filed Apr. 2, 2018, which is herein incorporated by reference.

STATEMENT OF GOVERNMENT SUPPORT

This invention was made under CRADA No. FP00006922 between A.O. Smith Corporation and Lawrence Berkeley National Laboratory, operated for the United States Department of Energy, and with government support under Contract No. DE-AC02-05CH11231 awarded by the U.S. Department of Energy. The government has certain rights in this invention.

TECHNICAL FIELD

This disclosure relates generally to burner apparatus and more particularly to natural draft lean premixed burner apparatus.

BACKGROUND

A premixed flame is a flame formed under specific conditions during the combustion of premixed gasses including a fuel and an oxidizer. For a premixed flame, the fuel and the oxidizer are mixed before reaching the reaction zone. Lean (i.e., a lower fuel-to-air ratio, as opposed to rich, a high fuel-to-air ratio) premixed flames offer the potential to provide heat output with very low emissions. However, lean premixed flames are highly unstable, especially when operating in a "natural draft" configuration with the combustion air not being driven by a "forced draft" where the combustion air is maintained above atmospheric pressure through the combustion system. This has limited their development and implementation.

SUMMARY

One innovative aspect of the subject matter described in this disclosure can be implemented in an apparatus including a burner plate, a burner body, and a mesh. A first surface of the burner plate defines a combustion surface for a fuel/air mixture. The burner plate defines a plurality of primary ports. The burner body defines a fuel-air mixing chamber. One surface of the burner body comprises the burner plate. The burner body defines an inlet for receiving air and a fuel in the fuel-air mixing chamber. The mesh is disposed in the fuel-air mixing chamber and is in contact with a second surface of the burner plate.

In some embodiments, the mesh is a wire mesh, a wire mesh screen, or a wire cloth. In some embodiments, the mesh defines about 25% to 75% open area. In some embodiments, the mesh is about 0.010 inches to 0.030 inches thick. In some embodiments, the mesh is a steel.

In some embodiments, the burner plate is a steel. In some embodiments, the burner plate is about 0.02 inches to 0.07 inches thick.

In some embodiments, the apparatus does not include a device that forces air and the fuel through the apparatus. In some embodiments, when the apparatus is in operation, air and the fuel are flowed into the fuel-air mixing chamber such a fuel-air equivalence ratio is less than 1 at the burner plate. In some embodiments, the apparatus is a natural draft burner apparatus operable to burn a mixture of air and the fuel. In some embodiments, the mixture of air and the fuel is generated in the fuel-air mixing chamber.

In some embodiments, each primary port of the plurality of primary ports defined in the burner plate is circular. In some embodiments, each of the primary ports has a diameter of about 0.2 inches to 0.325 inches. In some embodiments, the plurality of primary ports comprises about 2 to 500 primary ports. In some embodiments, the plurality of primary ports is defined in the burner plate such that centers of four adjacent primary ports form corners of a square. In some embodiments, a distance between an edge of a first primary port and an edge of a second primary port of the plurality of primary ports is about 0.125 inches or less.

In some embodiments, the burner plate further defines a plurality of secondary ports surrounding each primary port of the plurality of primary ports. In some embodiments, the plurality of secondary ports surrounding each primary port of the plurality of primary ports comprises about 4 to 14 secondary ports. In some embodiments, secondary ports of the plurality of secondary ports surrounding each primary port of the plurality of primary ports are arranged symmetrically around said primary port. In some embodiments, secondary ports of the plurality of secondary ports surrounding each primary port of the plurality of primary ports are equidistant from said primary port. In some embodiments, each secondary port of the plurality of secondary ports defined in the burner plate is circular. In some embodiments, each of the secondary ports has a diameter of about 0.045 inches to 0.075 inches. In some embodiments, a distance between an edge of a primary port of the plurality of primary ports and an edge of a secondary port of the plurality of secondary ports surrounding the primary port is about 0.2625 inches to 0.4375 inches. In some embodiments, a distance between an edge of a first secondary port and an edge of a second secondary port of the plurality of secondary ports surrounding a primary port of the plurality of primary ports is at least about 0.057 inches.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Figure 1A:
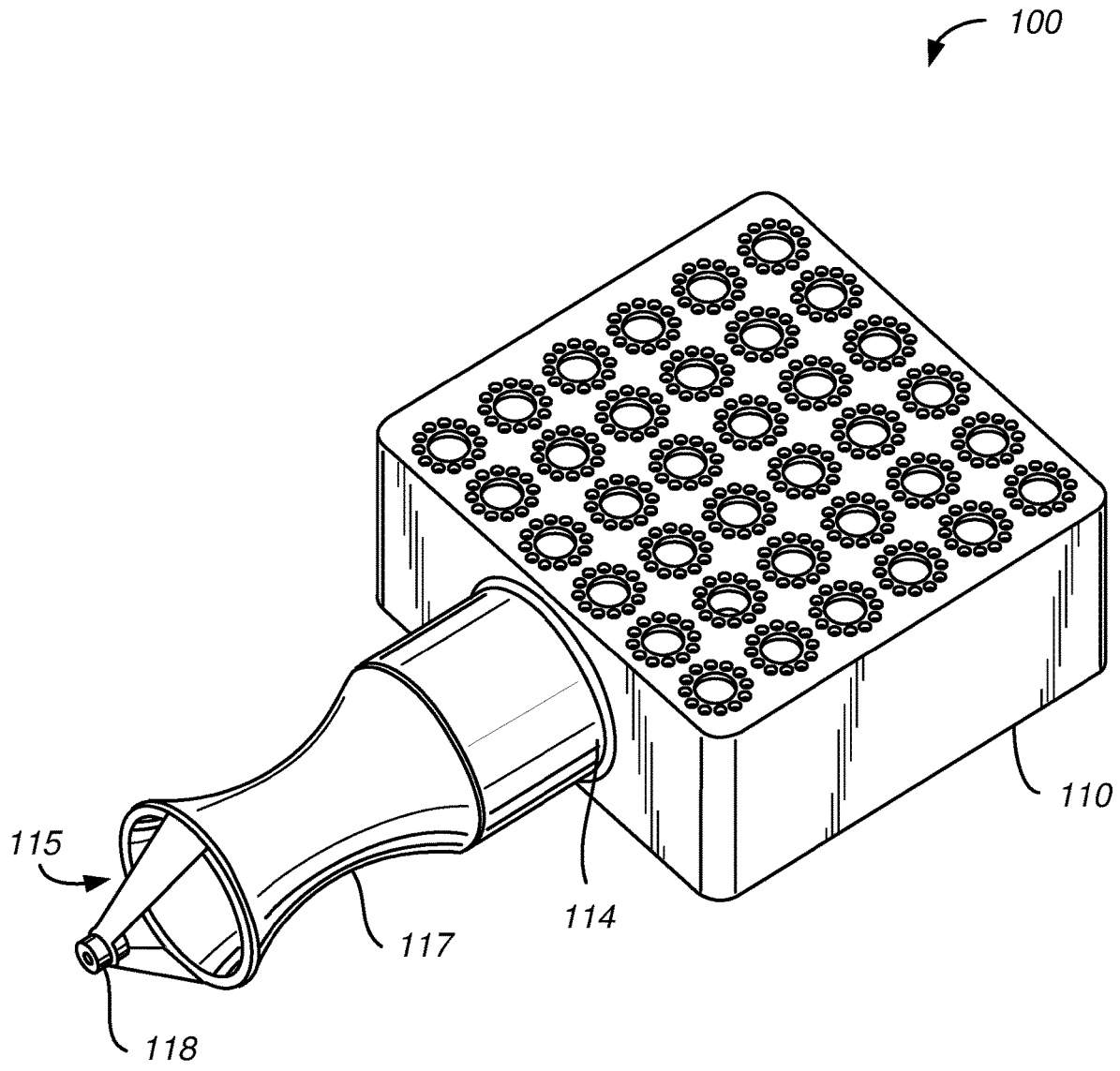
FIGS. 1A-1E show examples of illustrations of a burner apparatus.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

The terms "about" or "approximate" and the like are synonymous and are used to indicate that the value modified by the term has an understood range associated with it, where the range can be ±20%, ±15%, ±10%, ±5%, or ±1%. The terms "substantially" and the like are used to indicate that a value is close to a targeted value, where close can mean, for example, the value is within 80% of the targeted value, within 85% of the targeted value, within 90% of the targeted value, within 95% of the targeted value, or within 99% of the targeted value.

Lean premixed flames are desirable for their potential for ultra-low $NO_x$ emissions. However, lean premixed flames are unstable. The stability of lean premixed flames can be improved by employing a device, such as a fan, blower, or compressor, to force combustion air (i.e., the air containing oxygen that will be mixed with a fuel) through the combustion system.

Many combustion systems, however, cannot make use of such a forced draft configuration and must operate in a "natural draft" configuration in which a fan, blower, or compressor in not used to force combustion air through the combustion system. Due to the competing factors between burning velocity and bulk flow velocity, lean premixed flames have a tendency to flashback or lift off easily, especially when in a natural draft configuration. The stable operating range for lean premixed flames is narrow.

Embodiments described herein stabilize lean premixed flames in a natural draft configuration while offering the potential of arresting the flame if flashback should occur. Some embodiments include a wire mesh (e.g., a woven wire mesh) or wire cloth mesh that is placed directly under, and in contact with, a burner plate.

Figure 1B:
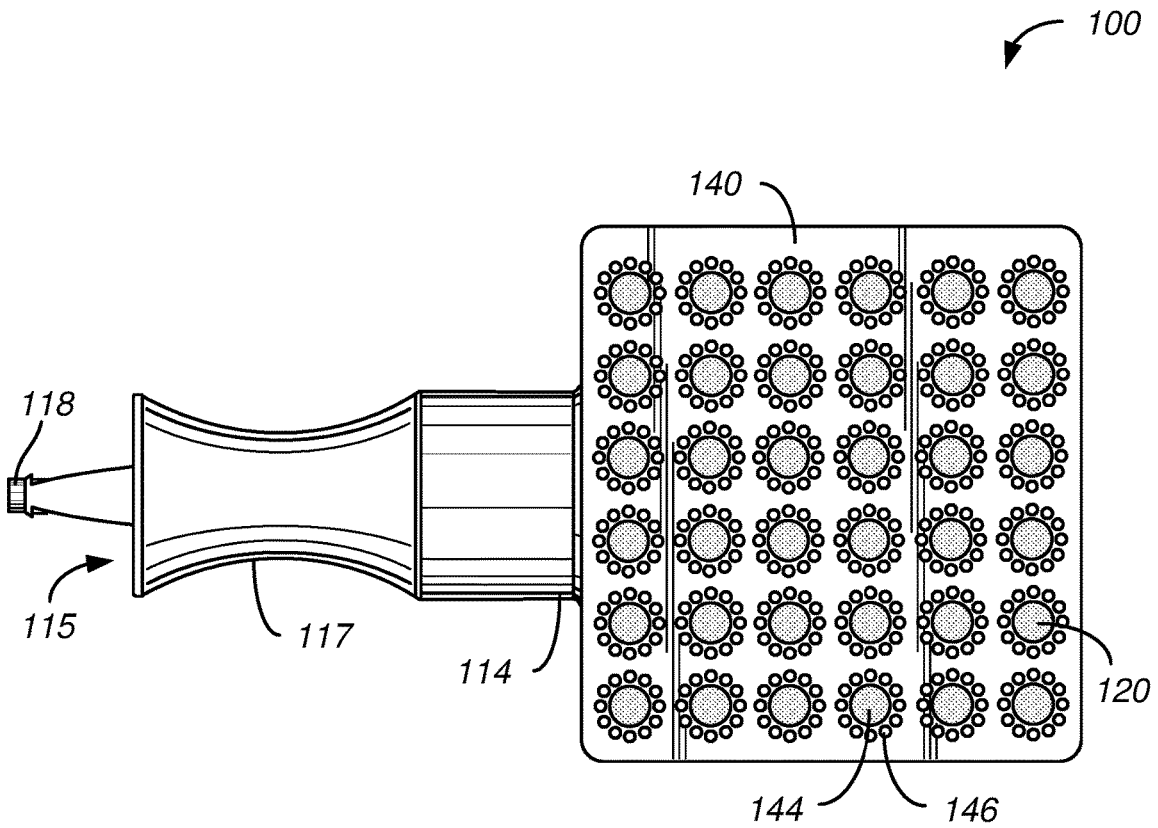
Figure 1C:
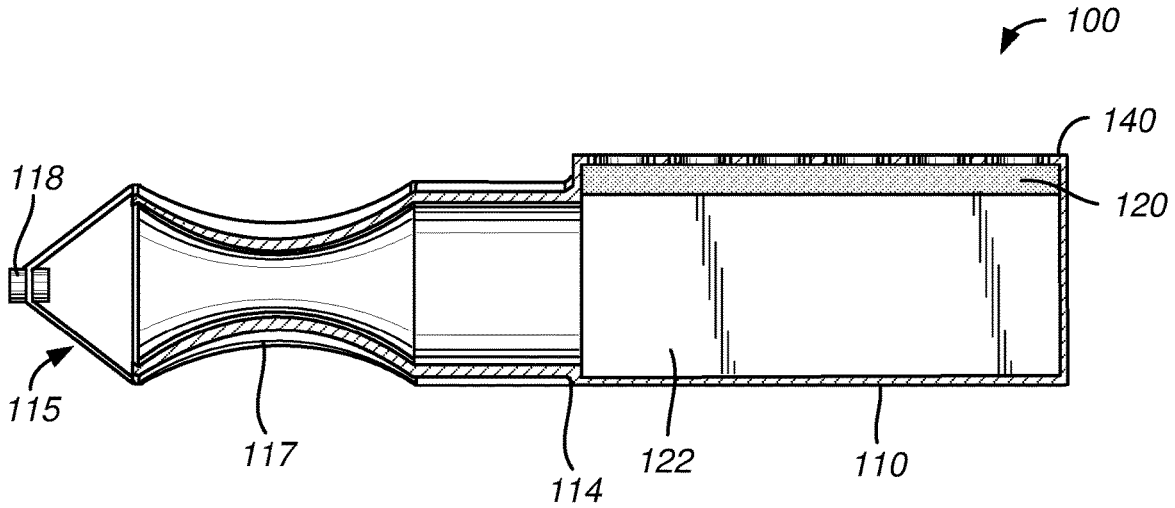
Figure 1D:
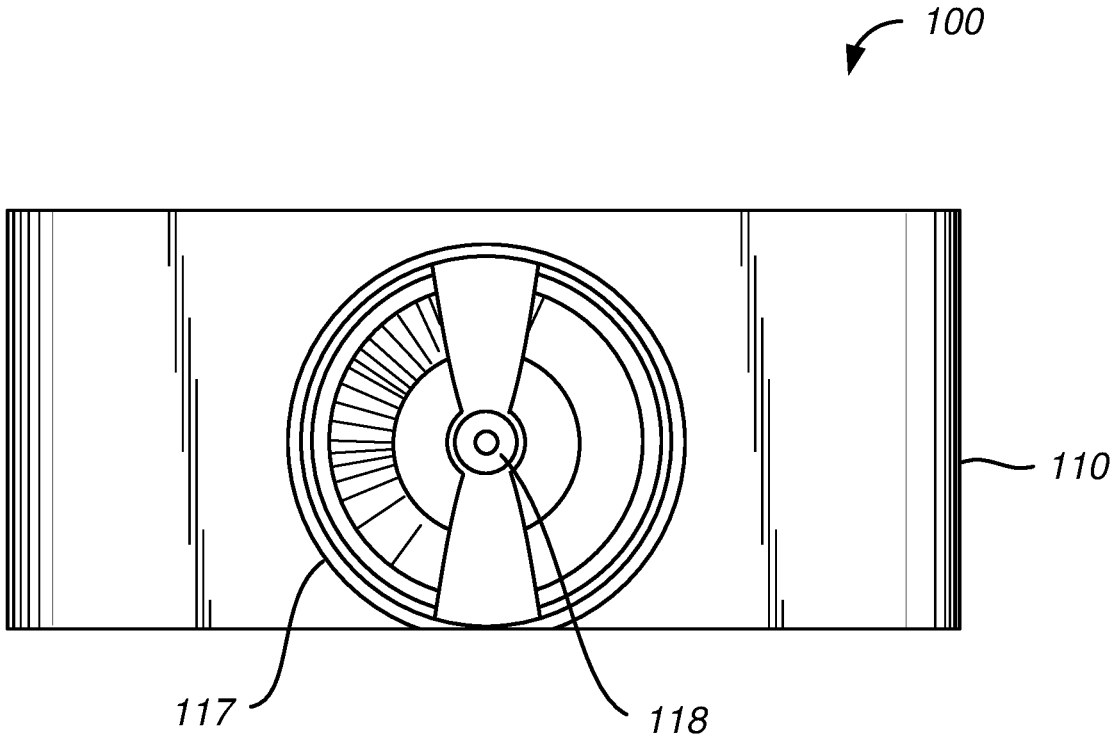
Figure 1E:
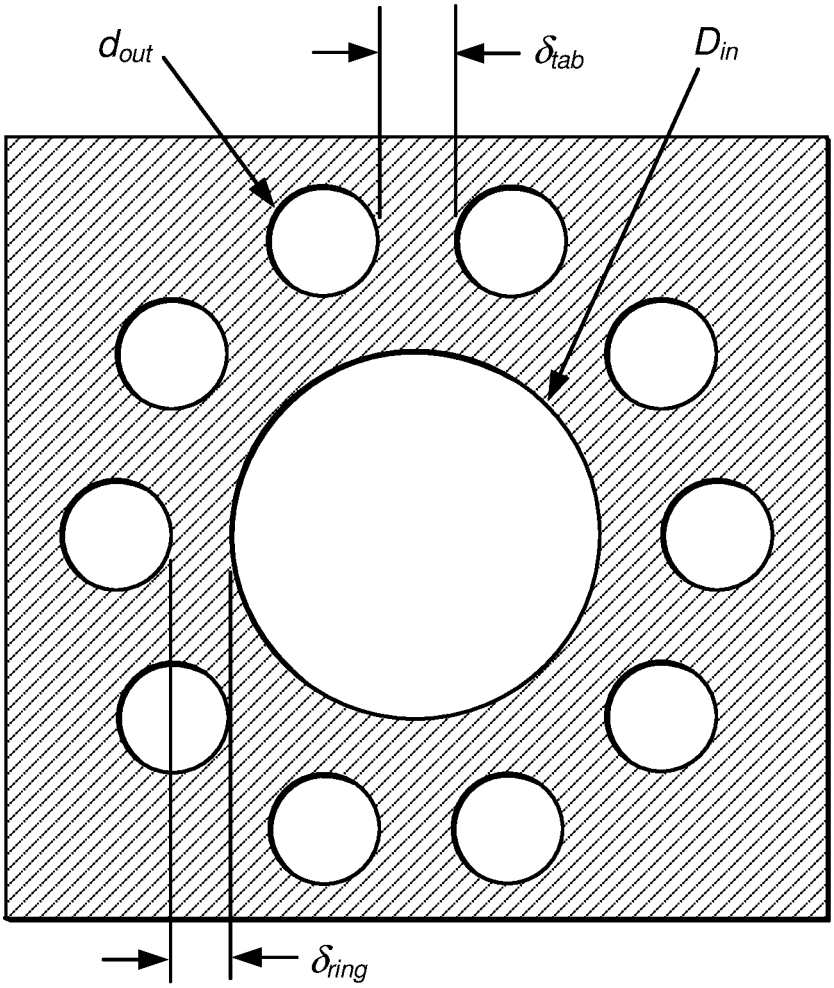

FIGS. 1A-1E show examples of illustrations of a burner apparatus. FIG. 1A shows an example of a schematic illustration of a burner apparatus. FIG. 1B shows an example of a top-down schematic illustration of a burner apparatus. FIG. 1C shows an example of a cross-sectional schematic illustration of a burner apparatus. FIG. 1D shows an example of an end-view schematic illustration of a burner apparatus. FIG. 1E shows a schematic illustration of a single primary port and the associated secondary ports defined in a burner plate.

As shown in FIGS. 1A-1E, a burner apparatus 100 comprises a burner body 110, an inlet 114 to the burner body 110, a mesh 120 disposed in a fuel-air mixing chamber 122, and a burner plate 140. The burner body 110 and the burner plate 140 define the fuel-air mixing chamber 122. The fuel-air mixing chamber 122 may also be referred to as a pre-mixing chamber. The fuel-air mixing chamber 122 is an open volume. The burner body 110 also defines the inlet 114 for receiving an air and a fuel in the fuel-air mixing chamber 122. In some embodiments, the fuel is in a gaseous state of matter when the burner apparatus 100 is in operation.

A first surface of the burner plate 140 defines a combustion surface for air and fuel that are delivered to the burner apparatus 100. In some embodiments, the burner plate 140 comprises a top surface of the burner apparatus 100. In some embodiments, the burner plate is about 0.02 inches to 0.07 inches thick.

The burner plate 140 defines a plurality of primary ports 144. In some embodiments, the burner plate further defines a plurality of secondary ports 146 surrounding each primary port of the plurality of primary ports 144. In some embodiments, the secondary ports 146 are arranged relative to a primary port 144 to aid in ensuring constant burning of the fuel/air mixture that flows though the burner plate 140. In some embodiments, the plurality of primary ports 144 and the plurality of secondary ports 146 are positioned such that adjacent ports are close enough to one another to ignite one another.

In some embodiments, the plurality of primary ports 144 comprises about 2 to 500 primary ports, or about 10 to 70 primary ports. In some embodiments, the plurality of secondary ports 146 surrounding each primary port of the plurality of primary ports 144 comprises about 4 to 14 secondary ports. In some embodiments, the plurality of primary ports 144 are defined in the burner plate 140 such that centers of four adjacent primary ports form corners of a square. In some embodiments, secondary ports of the plurality of secondary ports 146 surrounding each primary port of the plurality of primary ports 144 are arranged symmetrically around said primary port. In some embodiments, secondary ports of the plurality of secondary ports 146 surrounding each primary port of the plurality of primary ports 144 are equidistant from said primary port.

In some embodiments, each primary port of the plurality of primary ports 144 defined in the burner plate 140 is circular. In some embodiments, each of the primary ports 144 has a diameter of up to about and including 0.50 inches. In some embodiments, each of the primary ports 144 has a diameter of about 0.2 inches to 0.325 inches, or about 0.25 inches.

In some embodiments, each secondary port of the plurality of secondary ports 146 defined in the burner plate 140 is circular. In some embodiments, each of the secondary ports 146 has a diameter of about 0.045 inches to 0.075 inches, or about 0.06 inches.

In some embodiments, a distance between an edge of a primary port 144 and an edge of a secondary port of the plurality of secondary ports 146 surrounding the primary port is about 0.2625 inches to 0.4375 inches, or about 0.35 inches ($\delta_{ring}$ in FIG. 1E). In some embodiments, a distance between an edge of a first primary port and an edge of a second primary port of the plurality of primary ports 144 is about 0.125 inches or less. In some embodiments, a distance between an edge of a first secondary port and an edge of a second secondary port of the plurality of secondary ports 146 surrounding a primary port of the plurality of primary ports 144 is at least about 0.057 inches ($\delta_{tab}$ in FIG. 1E).

In some embodiment, the mesh 120 is in contact with a second surface of the burner plate 140. In some embodiments, the mesh 120 is held in contact with the second surface of the burner plate 140 using clamps (not shown). In some embodiments, the mesh 120 is welded (e.g., tack welded) to the second surface of the burner plate 140.

In some embodiments, the mesh is a wire mesh. A wire mesh may also be referred to as a wire mesh screen or a wire cloth. In some embodiments, the wire mesh is a woven metal having either square or rectangular openings between wires. In some embodiments, the mesh defines about 25% to 75% open area, about 29% to 73% open area, or about 41% open area. The percentage of open area in wire mesh is the ratio of the total open area of all of the openings in the mesh relative to the entire mesh area. In some embodiments, the mesh is less than about 0.050 inches thick, or about 0.010 inches to 0.030 inches thick. In some embodiments, the thickness of the mesh is determined by the diameter of the wires making up the mesh. In some embodiments, the wires in a mesh have a diameter of about 0.010 inches to 0.030 inches. In some embodiments, openings in the mesh are about 0.010 inches to 0.040 inches. Here, openings in the mesh as defined as the distance between two parallel, adjacent wires of the mesh. In some embodiments, a mesh size of the mesh is about 14×14 to 35×35.

Figure 2:
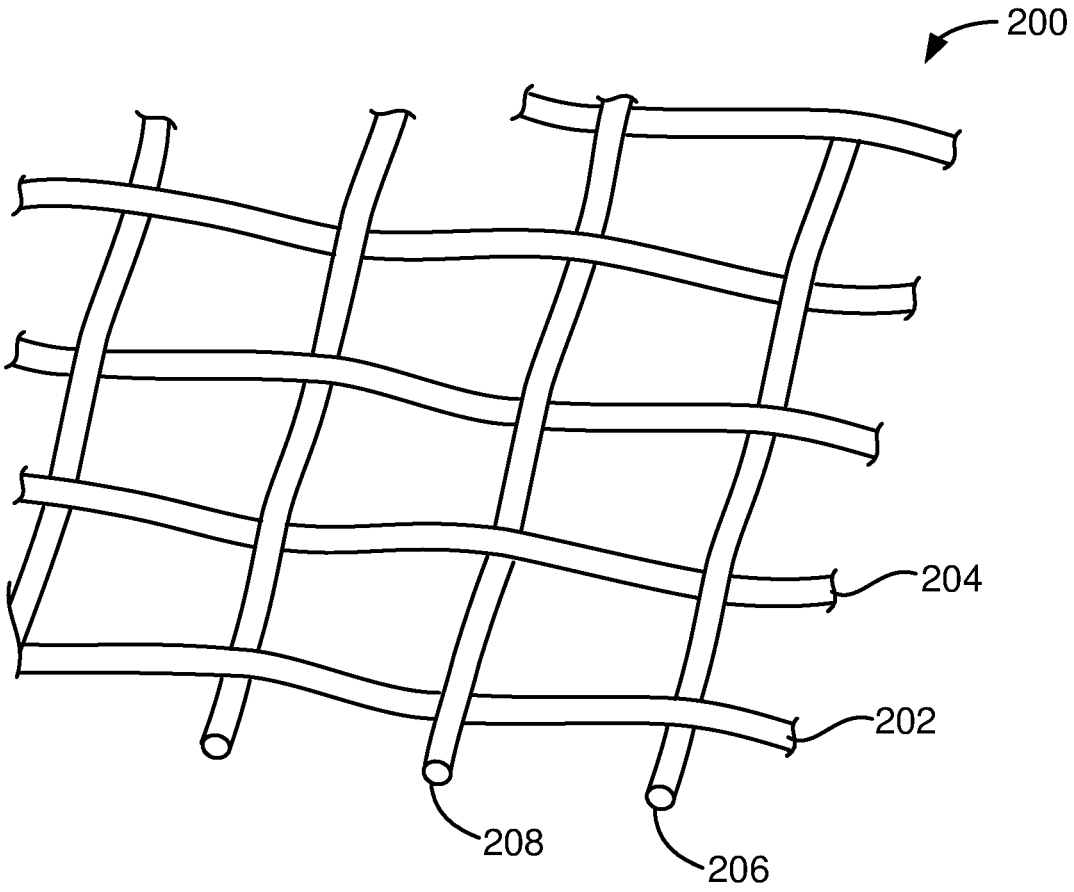
FIG. 2 shows an example of a schematic illustration of a wire mesh.

FIG. 2 shows an example of a schematic illustration of a wire mesh. Examples of wire meshes include screens for windows or doors and strainers for use in cooking. The wire mesh 200 includes a first set of wires (wires 202 and 204) that are substantially parallel to one another and a second set of wires (wires 206 and 208) that are substantially parallel to one another. The first set of wires is substantially perpendicular to a second set of wires, with the first set being woven with the second set. Other geometries of wire meshes can also be used. For example, some wire meshes may include three sets of wires with wires in each set being substantially parallel to one another. The three sets of wire may be woven together, with the three sets of wire not necessarily being substantially perpendicular to one another.

In some embodiments, attached to the inlet 114 of the burner body 110 is a venturi tube 117. In some embodiments, the end of the venturi tube 117 not attached to the burner body includes an inlet 115 operable for delivery of air to the burner body 110. In some embodiments, the inlet 115 is operable for delivery of air to the fuel-air mixing chamber 122 of the burner body 110.

In some embodiments, the venturi tube 117 is positioned such that air and the fuel flow though the venturi tube 117 and then into the burner body 110. In some embodiments, a fuel port 118 is suspended in front of the venturi tube 117. In some embodiments, the fuel port 118 is suspended by two support members attached to the venturi tube 117. When the burner apparatus 100 is in operation, as fuel flows through the fuel port 118, a stream of fuel is directed towards the venturi tube 117. The flow of the fuel creates a vacuum which draws air into inlet 115.

In some embodiments, the burner apparatus 100 is a metal (e.g., a steel or stainless steel). In some embodiments, the burner body 110 and the burner plate 140 are a metal. In some embodiments, the burner body 110 and the burner plate 140 are a steel (e.g., stainless steel) or comprise a steel. In some embodiments, the mesh 120 is the same material as the burner plate 140. In some embodiments, the mesh 120 is a metal. In some embodiments, the mesh is a steel (e.g., stainless steel) or comprises a steel.

In some embodiments, the burner apparatus 100 is a natural draft burner apparatus operable to burn a mixture of air and the fuel. In some embodiments, the mixture of air and the fuel is generated in the fuel-air mixing chamber 122. In some embodiments, the burner apparatus 100 is operable without a device that forces air and fuel into the apparatus 100. In some embodiments, the burner apparatus 100 does not include a device that forces air and gas through the apparatus 100. I.e., in some embodiments, the burner apparatus 100 does not include a fan, a blower, or a compressor.

In some embodiments, the when the burner apparatus 100 is in operation, the fuel and air are flowed into the fuel-air mixing chamber 122 such a fuel-air equivalence ratio is less than 1 at the burner plate 140. The fuel-air equivalence ratio is defined as the ratio of the actual fuel/air ratio to the stoichiometric fuel/air ratio. Stoichiometric combustion occurs when all the oxygen is consumed in the reaction, and there is no molecular oxygen ($O_2$) in the products. In some embodiments, the fuel/air mixture at the burner plate 140 is fuel lean.

A mesh 120 directly below and in contact with a burner plate 140 provides stability for lean premixed flames generated on the burner plate with primary ports and with primary ports and secondary ports. One theory behind the increased stability of the lean premixed flame in embodiments of the burner apparatus 100 is that the mesh 120 locally increases the velocity of unburned air-fuel mixture such that it exceeds the burning velocity (or flame speed) of the fuel. After passing through the mesh 120, the velocity of the unburned fuel/air mixture begins to decrease and matches the burning velocity of the fuel closer to the burner plate 140. Thus, the flame stabilizes on the burner plate 140. Another theory behind the increased stability of the lean premixed flame in embodiments of the burner apparatus 100 is that the mesh 120 quenches the flame locally at a primary port 144, preventing flashback and allowing the primary port to be re-ignited by an adjacent primary port.

Further, the mesh 120 may help increase flame stability by ensuring a uniform velocity distribution across each primary port 144, removing any perturbations in the flow. A non-uniform profile could destabilize the flame leading by presenting locations where the flame speed is higher than the bulk flow velocity, leading to flashback.

Any of the burner apparatus described herein can be operated as follows. A burner apparatus is provided. A fuel is flowed into a fuel-air mixing chamber of the burner apparatus. When a fuel is flowed into the fuel-air mixing chamber of the burner apparatus, the flow of the fuel also draws air into the fuel-air mixing chamber. A fuel-air mixture is formed in the fuel-air mixing chamber. In some embodiments, air and the fuel are flowed into the fuel-air mixing chamber such a fuel-air equivalence ratio is less than 1 at the burner plate of the burner apparatus. The fuel-air mixture is ignited and forms a flame on the burner plate. In some embodiments, the flame attaches to the primary ports (and secondary ports, if present) of the burner plate. In some embodiments, the flame does not attach to the mesh. In some embodiments, the mesh in contact with the burner plate arrests flashback of the flame.

Example

The following examples are intended to be examples of the embodiments disclosed herein, and are not intended to be limiting.

Described below is the development a stable ring burner (i.e., a burner apparatus with a burner plate defining primary ports and secondary ports) for water heater applications using a natural draft air/fuel injection system. We retrofitted a combustion burner for a hot water heater by replacing the mesh burner with a ring burner.

The existing mesh burner included a woven screen of exotic alloy metal wires (e.g., Inconel (Special Metals Corporation, New Hartford, N.Y.)). The flame attached to the individual wires of the mesh burner but did not propagate upstream towards the fuel injection source as the mesh acted as a localized flame quench. Mesh stabilized burners are common but suffer from early failure due to the high thermal stresses they encounter during normal operation.

After removing the mesh burner and installing a ring burner, we learned that the natural draft air injection system was a problem as it created a pulsing wave in the burner apparatus and did not evenly or uniformly distribute the air/fuel mixture to each port. The ring burner also consistently flashed back.

In one attempt to address this problem, we focused on the fuel/air mixing chamber. In this chamber, we added mixing baffles, perforated plates, and mesh screens (coarse and fine stainless steel meshes and coarse and fine aluminum meshes) inside the premixing chamber. Almost all of them resulted in flashback. A fine aluminum mesh had the most promise for stability, but did not provide repeatable results. Further, the design did not allow for enough air entrainment to achieve lean enough combustion to meet the low NOx requirements and also produced a significant amount of CO.

One solution to the problem was to couple ring burners (which have been proven to stabilize lean premixed flames well when the reactant flow field is well developed) with a mesh screen directly below and in contact with the burner plate. The burner plate comprised a sheet metal plate with an array of ring burners on it. The woven wire mesh contained less than about 65% open area, was about 0.010" to 0.030" thick, and was generally woven in a square pattern.

It was expected that a lean premixed flame would attach to the mesh as it did with a mesh burner. Instead, the lean premixed flame attached to the ring burners that make up the burner plate. The flame did not attach to the mesh, allowing for more traditional metals to be used as compared to those used in mesh burners. Additional testing demonstrated that a number of different types of ports cut into the burner plate could be used when the mesh was placed directly behind or in contact with the burner plate.

CONCLUSION

The described embodiments for natural draft lean, premixed burner apparatus prevent flashback, provide enhanced stability (especially if premixed air and fuel do not reach the burner in a uniform or straight manner), and provide greater reliability in burner operation (as local velocity at the ports of the burner apparatus is increased to help ensure the bulk flow velocity of the unburned air/fuel mixture is faster than the flame speed of fuel). These embodiments will help expand use of lean (e.g., equivalence ratio from 0.59-0.70 for natural gas), premixed burners to support low emissions and improved efficiency.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. An apparatus comprising:

a burner plate, a first surface of the burner plate defining a combustion surface for a fuel/air mixture, the burner plate defining a plurality of primary ports, each primary port of the plurality of primary ports defined in the burner plate being circular, and each of the primary ports having a diameter of about 0.2 inches to 0.325 inches;

a burner body defining a fuel-air mixing chamber, one surface of the burner body comprising the burner plate, the burner body defining an inlet for receiving air and a fuel in the fuel-air mixing chamber; and a mesh disposed in the fuel-air mixing chamber, the mesh being in contact with a second surface of the burner plate, the mesh being a wire mesh, a wire mesh screen, or a wire cloth.

2. The apparatus of claim 1, wherein the mesh defines about 25% to 75% open area.

3. The apparatus of claim 1, wherein the mesh is about 0.010 inches to 0.030 inches thick.

4. The apparatus of claim 1, wherein the mesh is a steel.

5. The apparatus of claim 1, wherein the burner plate is a steel.

6. The apparatus of claim 1, wherein the burner plate is about 0.02 inches to 0.07 inches thick.

7. The apparatus of claim 1, wherein the apparatus does not include a device that forces air and the fuel through the apparatus.

8. The apparatus of claim 1, wherein when the apparatus is in operation, air and the fuel are flowed into the fuel-air mixing chamber such a fuel-air equivalence ratio is less than 1 at the burner plate.

9. The apparatus of claim 1, wherein the apparatus is a natural draft burner apparatus operable to burn a mixture of air and the fuel.

10. The apparatus of claim 9, wherein the mixture of air and the fuel is generated in the fuel-air mixing chamber.

11. The apparatus of claim 1, wherein the plurality of primary ports comprises about 2 to 500 primary ports.

12. The apparatus of claim 1, wherein the plurality of primary ports is defined in the burner plate such that centers of four adjacent primary ports form corners of a square.

13. The apparatus of claim 1, wherein a distance between an edge of a first primary port and an edge of a second primary port of the plurality of primary ports is about 0.125 inches or less.

14. The apparatus of claim 1, wherein the burner plate further defines a plurality of secondary ports surrounding each primary port of the plurality of primary ports.

15. The apparatus of claim 14, wherein the plurality of secondary ports surrounding each primary port of the plurality of primary ports comprises about 4 to 14 secondary ports.

16. The apparatus of claim 14, wherein secondary ports of the plurality of secondary ports surrounding each primary port of the plurality of primary ports are arranged symmetrically around said primary port.

17. The apparatus of claim 14, wherein secondary ports of the plurality of secondary ports surrounding each primary port of the plurality of primary ports are equidistant from said primary port.

18. The apparatus of claim 14, wherein each secondary port of the plurality of secondary ports defined in the burner plate is circular, and wherein each of the secondary ports has a diameter of about 0.045 inches to 0.075 inches.

19. The apparatus of claim 1, wherein the mesh is a woven metal wire mesh.

20. The apparatus of claim 14, wherein a distance between an edge of a primary port of the plurality of primary ports and an edge of a secondary port of the plurality of secondary ports surrounding the primary port is about 0.2625 inches to 0.4375 inches.

* * * * *